United States Patent [19]

Lynch

[11] Patent Number: 4,885,891

[45] Date of Patent: Dec. 12, 1989

[54] REINFORCEMENT MEMBER FOR AN EXTENDIBLE SCISSORS TRUSS

[76] Inventor: James P. Lynch, 13 South Field, Lakewood, Colo. 80226

[21] Appl. No.: 238,452

[22] Filed: Aug. 30, 1988

[51] Int. Cl.[4] ..... E04H 12/18

[52] U.S. Cl. ..... 52/646; 135/110

[58] Field of Search ..... 52/109, 643, 645, 646, 52/641, 632, 651; 135/97, 110; 74/521; 211/105; 182/69, 157; 248/324

[56] References Cited

U.S. PATENT DOCUMENTS

| | | | |
|---|---|---|---|
| 494,824 | 4/1893 | Pitt | 160/159 |
| 600,281 | 3/1898 | Garland | 182/157 |
| 942,638 | 12/1909 | Vaghi | 182/157 |
| 4,641,676 | 2/1987 | Lynch | 135/110 |
| 4,779,635 | 10/1988 | Lynch | 52/109 |

FOREIGN PATENT DOCUMENTS

| | | | |
|---|---|---|---|
| 560818 | 6/1977 | U.S.S.R. | 254/122 |

*Primary Examiner*—James L. Ridgill, Jr.

*Attorney, Agent, or Firm*—Timothy J. Martin; J. Preston Oxenham

[57] ABSTRACT

A reinforcement member is provided for an extendible scissors truss such as may be utilized in a collapsible canopy structure wherein the extendible scissors truss has members pivotally connected to form truss cells. The reinforcement member has first and second end portions joined by a linking portion to form a Z-like configuration. The first and second end portions of the reinforcement member are each attached, at an end point, to one of a pair of parallel members of a cell, and lie laterally adjacent the truss members when the extendible scissors truss is in an extended position. The cell is thereby reinforced against moments resulting from side forces applied to the truss by torsion and bending stress developed in the linking portion of the reinforcement member.

22 Claims, 4 Drawing Sheets

REINFORCEMENT MEMBER FOR AN EXTENDIBLE SCISSORS TRUSS

TECHNICAL FIELD

The present invention generally relates to extendible scissors trusses which form expandable support frameworks. Specifically, the invention relates to reinforcement members to strengthen such trusses, especially where the reinforced trusses are used as structural support members in collapsible protective shelters.

BACKGROUND OF THE INVENTION

Conventional extendible scissors trusses are made up of a number of truss members pivotally joined at their points of crossing to define generally quadrilateral shaped truss cells. Commonly, these trusses are made up of two sets of parallel members which form one or more parallel sided or diamond-shaped cells when the truss is extended. Generally, all of the truss members of at least one of the truss member sets will rotate in a common plane during extension of the truss. Conventional extendible scissors trusses of this nature are used as columns or beams in collapsible structures, to maintain elements of mechanisms in a parallel relationship while allowing the distance between them to be varied, and to serve as collapsible fences or barriers.

An example of the use of these trusses as barriers is the familiar child gate extended across the head of a staircase to prevent children from falling down stairways. Such child gates can be collapsed to one side against a supporting post or wall and selectively extended to provide a guard barrier. Examples of extendible scissors trusses used to maintain elements of mechanisms in a parallel but extendible relationship are found in camera bellows, wherein an extendible scissors truss maintains a lens assembly in parallel relation to a film plane in the camera body when the camera is opened and the lens assembly extended, and in mechanisms by which a platform, such as a truck body, is elevated above its supporting structure. Use of extendible scissors trusses as beams in collapsible structures may be observed in portable stage structures where the extendible scissors trusses are employed between supporting legs or columns to maintain them in vertical parallel relationship and, in some instances, to carry vertical loads from the platform to the legs or columns. An example of collapsible structures utilizing extendible scissors trusses as structural members may be found in my U.S. Pat. No. 4,641,676 which discloses a collapsible canopy structure including extendible scissor truss assemblies.

While conventional extendible scissors trusses have great strength and may be very stiff in resisting loads resulting from forces in the plane of their truss cells and the related moments normal to those cells, they are generally weak and relatively flexible when subjected to side loads imposed by forces acting normal to the plane of the truss cells and the related moments lying in the planes of the cells. The lack of stiffness of conventional extendible scissors trusses not only limits their ability to carry loads normal to the planes of the truss cells, but also reduces the longitudinal or column load which prior art scissors trusses can safely accommodate without danger of structural failure due to buckling of the truss.

DISCLOSURE OF THE INVENTION

It is an object of the present invention to improve the usefulness of extendible scissors trusses in load bearing structures, and most particularly, as load bearing members in collapsible, protective shelters.

It is, therefore, an object of the present invention to improve the performance of extendible scissors trusses in resisting side loads normal to the truss cells and related moments lying in the plane of the truss cells. Accordingly, it is an object to increase the critical column load, or longitudinal compressive force, which may be imposed upon the extendible scissors truss without danger of the truss becoming unstable and buckling.

A further object of the present invention is to reduce the bending moments which must be carried by pivotal attachment points between extendible scissors truss members.

It is also an object of the present invention to allow modification of existing trusses to improve structural performance and strength.

Moreover, it is an object of the present invention to achieve the above objectives by means of a reinforcement member that maintains the benefits of collapsibility of extendible scissors trusses for convenience in storage and transport especially when used with collapsible canopy structures.

The present invention, then, employs a reinforcement member to provide an extendible scissors truss which exhibits greater stiffness and which can carry greater side loads and support greater column loads than prior art extendible scissors trusses. An exemplary preferred embodiment comprising the present invention is directed to a reinforcement member for an extendible scissors truss wherein the truss has a plurality of truss members pivotally attached to one another to define a quadrilateral truss cell. The truss cell has a first pair of opposing corners that define a first reference axis lying generally in the direction of extension of the scissors truss, and a second pair of corners which define a second reference axis which crosses the first axis when the truss is in an extended configuration. The reinforcement member includes first and second end portions each having a distal end and a linking portion extending between the first and second end portions. Attachment means are provided to attach the first end portion laterally adjacent to a first truss member and the second end portion laterally adjacent a second truss member. Preferably, these attachments are made proximate to the respective distal ends of each end portion. The linking portion rigidly interconnects the first and second end portions and is rigidly joined to the first end portions at a first connection point spaced from the distal end of the first end portion and rigidly joined to the second end portion at a second connection point spaced from the distal end of the second end portion in such manner that, when the extendible scissors truss is in an extended configuration, the first and second connection points laterally abut the first and second truss member respectively. Thus, the end portions define lever members to produce moment couples on the first and second truss members that resist torsional and bending stress forces.

The preferred embodiment of the present invention, the reinforcement member spans a quadrilateral truss cell between two truss members forming generally opposite sides of the cell. The central linking portion and the end portions of the reinforcement member, together, preferably form a Z-like configuration with the end portions at the top and bottom of the Z in a common plane with the central linking portion. The end portions are each pivotally attached to one of the opposing truss members. The angles of the Z, formed where the linking member is connected to the end portions, is such that, when the truss is in an extended configuration, each end portion lies parallel to and laterally abuts the truss member to which it is attached. Generally, the truss members to which the reinforcement member is pivotally attached lie to the same side of the plane of the reinforcement member. In this configuration, when the ends of the truss are fixed and a side force is applied to the truss in a direction perpendicular to the plane of the reinforcement member, torsion and bending stress may be developed within the linking portion of the reinforcement member which resists the bending moments imposed upon the cell by imposing a moment couple on each of the truss members via the end portions. This reduces the moments acting upon pivot points of the cell and the extendible scissors truss is stiffened.

In addition to a truss cell so constructed as to employ the reinforcement member described above, the present invention further includes an expandable canopy structure utilizing the reinforced truss assemblies. It should be appreciated, in this application, two reinforcement members may be provided for each truss cell, the members being mounted on opposite sides thereof to resist both clockwise and counter-clockwise torsional forces as well as side forces to either side of the truss cell.

These and other objects of the present invention will become more readily appreciated and understood from a consideration of the following detailed description of the preferred embodiment when taken together with the accompanying drawings, in which:

DESCRIPTION OF THE PREFERRED EMBODIMENT

The present invention is generally directed to reinforcement members for scissors truss assemblies, and more specifically to the construction of a scissor truss assemblies including such reinforcement members. Further, the present invention is especially directed to collapsible shelters, such as canopy structures, which are extendible between a stored stage and an erect stage by means of such scissor trusses. The reinforcement member of the present invention helps resist side forces against perpendicular surfaces of such structures, such as those caused by wind and the like, which create bending and torsional forces on the trusses. However, it should be fully understood that, although the present invention is described with respect to such structures, the broad concept of the present invention is applicable to many types of scissor and truss assemblies formed of polygonal truss cells. However, it should also be appreciated that, in the most common application, these truss cells are quadrilateral truss cells formed by opposite pairs of truss members.

Figure 1:
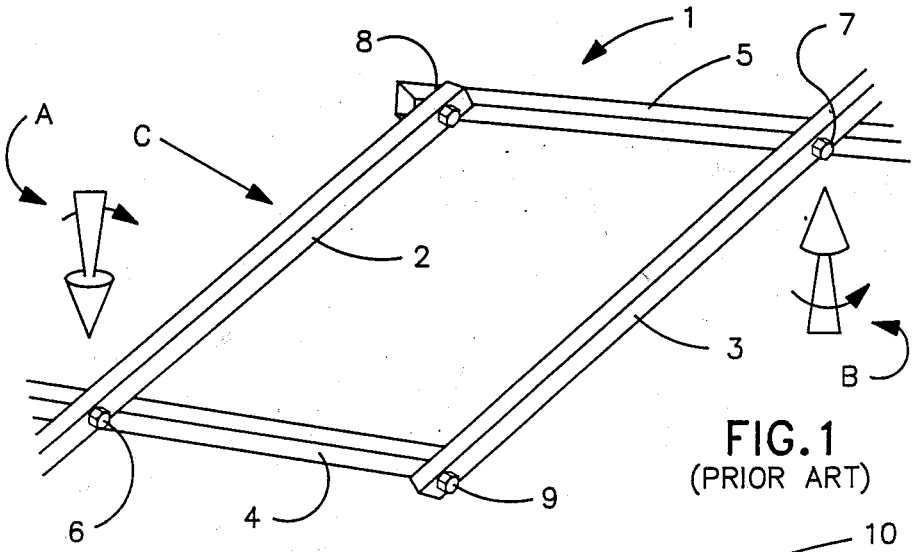
FIG. 1 (PRIOR ART)
FIG. 1 is a perspective view of a scissor truss cell of a prior art extendible scissors truss.

For purposes of description, then, a generalized truss cell is shown in FIG. 1. As is illustrated in FIG. 1, a typical scissor truss is in the form of a quadrilateral scissor cell 1 formed by a first pair of opposite truss members 2,3 and a second pair of opposite truss members 4,5. Truss members 2 and 4 are pivotally attached to one another at 6, and truss members 3 and 5 are pivotally attached to one another at 7. Two butt end pivot points 8 and 9 are provided for a pair of scissor assemblies with a pivotal interconnection between the butt ends of truss members 2 and 5 at 8 and pivotal interconnection between the butt ends of truss members 3 and 4 at 9. Pivot points 6 and 7 thus define a first reference axis, I, generally along the direction of extension of the scissor truss and pivot points 8 and 9 define a second reference axis, II normal to the first axis. The cell 1 illustrated in FIG. 1 would be weak in resisting moments such as those represented by vectors A and B which result from side force loads imposed on the truss between its fixed ends, such as force C of FIG. 1. These moments have components parallel to a reference axis II, defined by butt end pivot points 8 and 9, which must be resisted by joints at 8 and 9. It is not unusual that the joints at 8 and 9 will fail upon sufficient side forces having components perpendicular to the plane of cell 1.

Figure 2:
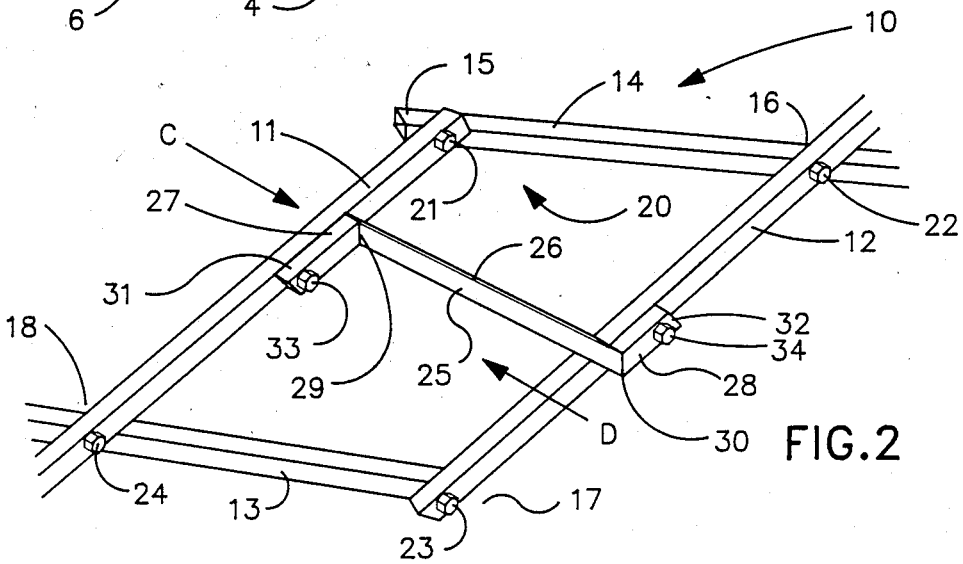
FIG. 2 is a perspective view of a cell of an extendible scissors truss with a reinforcement member embodying the present invention.
Figure 3:
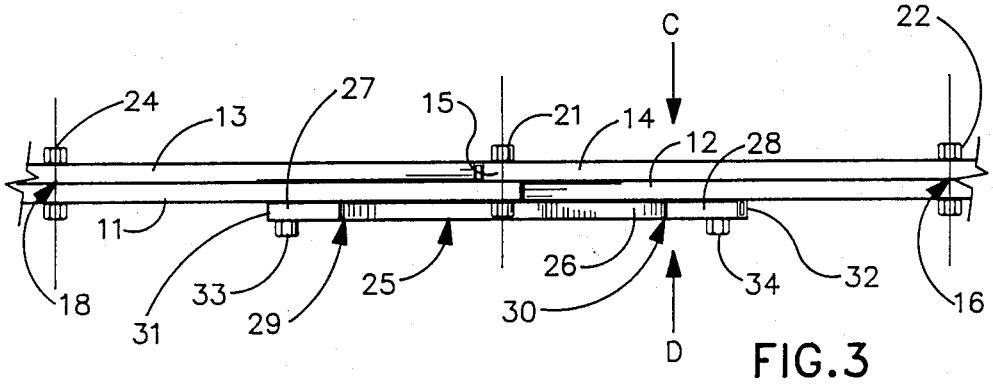
FIG. 3 is a top view of the extendible scissors truss embodying the present invention shown in FIG. 2.

In accordance with the invention, an exemplary extendible scissors truss 10, including a reinforcement member 25 according to the present invention, is shown in FIGS. 2 and 3 in an extended configuration. Truss members 11, 12, 13, and 14 are pivotally attached at points 15, 16, 17, and 18 to define cell 20. In the extendible scissors truss 10, truss members 11 and 12 rotate in a common plane during extension or collapse of the truss 10 as do truss members 13 and 14. Pivotal attachment of the truss members at the points 15, 16, 17 and 18 is provided in the exemplary embodiment by threaded nut and bolt sets 21, 22, 23 and 24, respectively, which pass through aligning holes provided in the truss members at each of the pivotal attachment points 15, 16, 17 and 18.

In the exemplary extendible scissors truss 10, truss members 11 and 12 are parallel to one another as are truss members 13 and 14. When the configuration of the exemplary extendible scissors truss 10 is changed from the extended configuration of FIGS. 2 and 3 to its collapsed or compact configuration, as is known in the art, pivotal attachment points 17 and 15 move away from one another along reference axis II while pivotal attachment points 16 and 18 approach one another along reference axis I until such time as truss members 11 and 12 are lying against one another and truss members 13 and 14 are lying against one another. Cross members 11, 12, 13 and 14 may be made of any suitably rigid material, for example, wood, metal, or plastic.

Reinforcement member 25 includes linking portion 26 and end portions 27 and 28. The end portions 27 and 28 of reinforcement member 25 of the exemplary embodiment are parallel to one another and joined to linking portion 26 at connection points 29 and 30, respectively, at a common obtuse angle so that reinforcement member 25 is of a generally Z-like configuration. The distal ends 31 and 32 of end portions 27 and 28 are pivotally attached to truss members 11 and 12, respectively, by pivotal attachment means, for example, threaded nut and bolt sets 33 and 34.

In the preferred embodiment of scissor truss 10, the points of pivotal attachment 31 and 32 of end portion 27 and 28 by nut and bolt sets 33 and 34 are respectively equidistant between nut and bolt sets 21 and 24 and between nut and bolt sets 22 and 23. It is particularly important that, for the truss to scissor, nut and bolt sets 33 and 34 lie on a line that is parallel to both cross members 13 and 14. The angle between each of the end portions 27 and 28 and the linking portion 26 is such that, when the exemplary extendible scissors truss 10 is in an extended configuration, end portions 27 and 28 lie parallel to and laterally abut truss members 11 and 12, respectively. In the preferred exemplary embodiment, end portions 27 and 28 are attached to a side of members 11 and 12 opposite that to which members 13 and 14 are attached so that the reinforcement member 25 does not prevent truss members 13 and 14 from abutting one another when the extendible scissors truss 10 is in its collapsed configuration.

The presence of reinforcement member 25 reduces bending stresses imposed on pivotal attachment points 15 and 17 and stiffens the exemplary extendible scissors truss 10. For example, when the ends of exemplary extendible scissors truss 10 are fixed and the truss is subject to a side load force, such as force C in FIG. 3, the truss cell 10 is subject to moments such as those represented by torsion vectors A and B. Thus, when such a force is applied to the extendible scissors truss 10, pivotal attachment points 15 and 17 tend to move in the direction of the force, toward the lower right in FIG. 2, relative to pivotal attachment points 16 and 18. This creates a tensile force in the nut and bolt sets 33 and 34 at the distal ends of reinforcement member end portions 27 and 28 and a compression force between the reinforcement member 25 and adjacent truss members 11 and 12 in the proximity of the connection points 29 and 30 so that end portions 27 and 28 act as lever members to produce moment couples on truss members 11 and 12, respectively. This produces torsion and bending stresses in the linking portion 26 which oppose the moment applied to the truss cell 20, reducing torsional stress on the pivotal attachment points 15 and 17 and reducing deformation of the cell 20.

End portions 27 and 29 may be made shorter or longer than illustrated in FIG. 3 to result in formation of an obtuse, right, or acute angle between linking portion 26 and each of the end portions 27, 28. Selection of the angle will depend upon environmental and geometric constraints, loads to be accommodated by the truss and the materials employed in the structure. Though the reinforcement member 25 is shown as spanning a single cell in FIG. 3, those familiar with the art will understand that reinforcement member 25 may be used to strengthen a larger cell including two or more smaller cells. Reinforcement member 25 may be formed of any suitably, rigid material, for example, plastic, metal or wood. Linking portion 26 may be made of hollow extruded material or plastic to provide greater torsional and bending rigidity with relatively little structural weight. Any suitable means for pivotal attachment may be used, for example, rivets or shafts with cotter pins. If bolts are used, cross members 11 and 12 may be bored and tapped. If the truss members are hollow, nuts may be welded within them to receive bolts passing through the reinforcement member 25 and eliminate the need for nuts on the far side of the members 11 and 12 which might interfere with members 13 and 14 when the extendible scissors truss is in its collapsed configuration.

While in the preferred embodiment of FIGS. 2 and 3 a sharp angle is formed at the points of attachment 29 and 30, the reinforcement member need not be Z-shaped. Any reinforcement member shape providing a linking member 24, pivotal attachment points at 31 and 32 and connection points 29 and 30 laterally abutting truss members 11 and 12, may be utilized to create lever arms. Three possible reinforcement member configurations are shown in FIGS. 4*b*–4*d*, all of which are specific examples of a generalized schematic illustration of a reinforcement member for a trapezoidal truss cell shown in FIG. 4*a*.

Figure 4A:
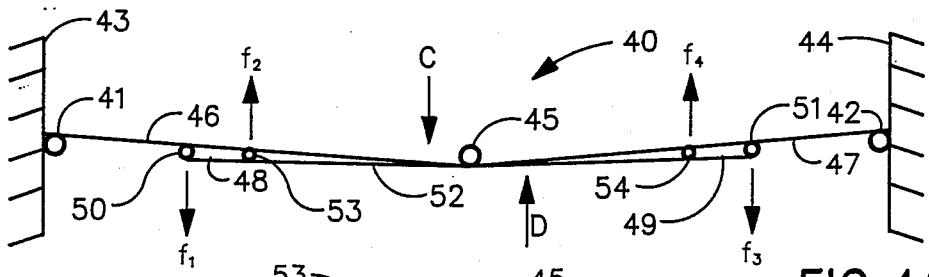
FIG. 4 is a schematic illustration of exemplary alternative embodiments of the reinforcement member of the present invention.
Figure 4D:
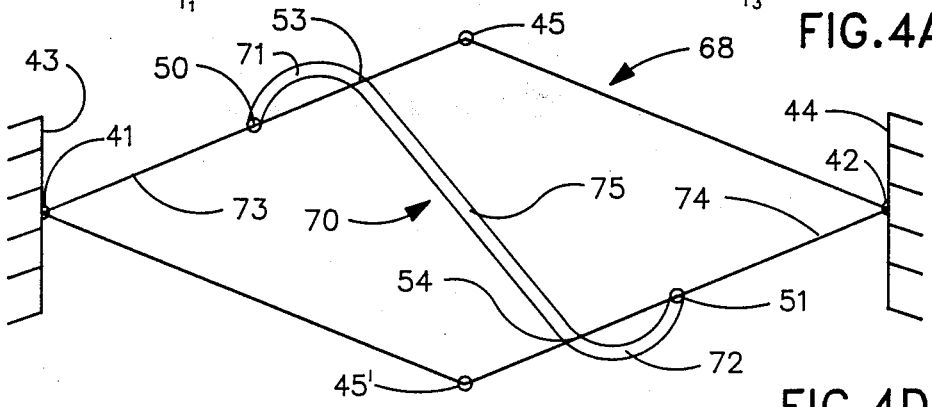

In FIG. 4*a*, the generalized truss cell 40 extends between a pair of pivot points 41 and 42 respectively mounted on generalized support elements 43 and 44. Truss cell 40 has a central pivot point 45 which corresponds to the pivotal attachment points of abutting ends at locations 15 and 17 discussed with respect to the preferred embodiment, above. Truss cell 40 further includes a pair of truss members 46 and 47 which are reinforced by a reinforcement member having end portions 48 and 49 which are connected, at their distal ends, at locations 50 and 51, to truss members 46 and 47 respectively. A central linking portion 52 rigidly interconnects end portions 48 and 49 and is secured to end portions 48 and 49 at locations 53 and 54 respectively. In this configuration, the reinforcement member strengthens the cell against side forces in the direction shown by vector C.

Figure 4B:
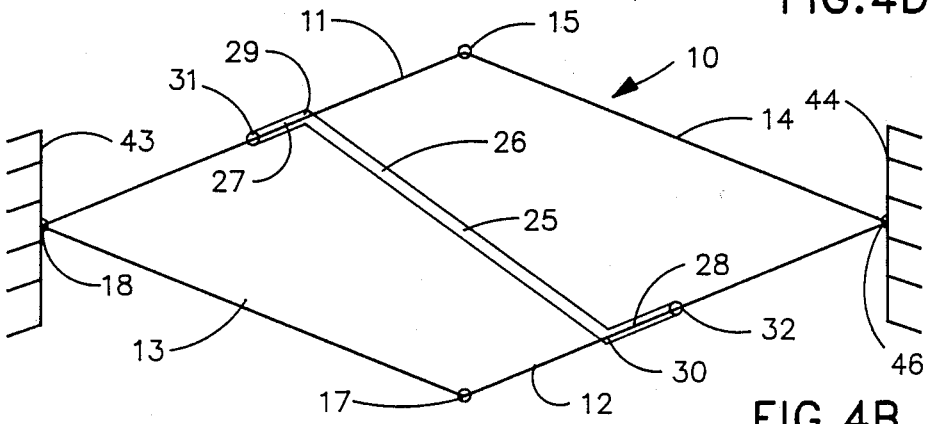

FIG. 4*b* shows the preferred embodiment of the present invention, as discussed above, as it relates to this generalized format. Here, it may be seen that truss cell 10 extends between pivot points 16 and 18 which respectfully correspond to pivot points 42 and 41 in FIG. 4*a*. Reinforcement member 25 has a pair of end portions 27 and 28 which correspond to end portions 48 and 49, with these end portions respectively terminating at distal ends 31 and 32, corresponding to locations 50 and 51 in FIG. 4*a*. Linking portion 26 is linear and extends between connection points 29 and 30 which correspond to connection points 53 and 54 in FIG. 4*a*. Also, from this description it should be appreciated that generalized support elements 43 and 44 can be a further extension of cross members 11–14 or can be other support elements of virtually any type for which relative movement toward and away from one another is desired.

Figure 4C:
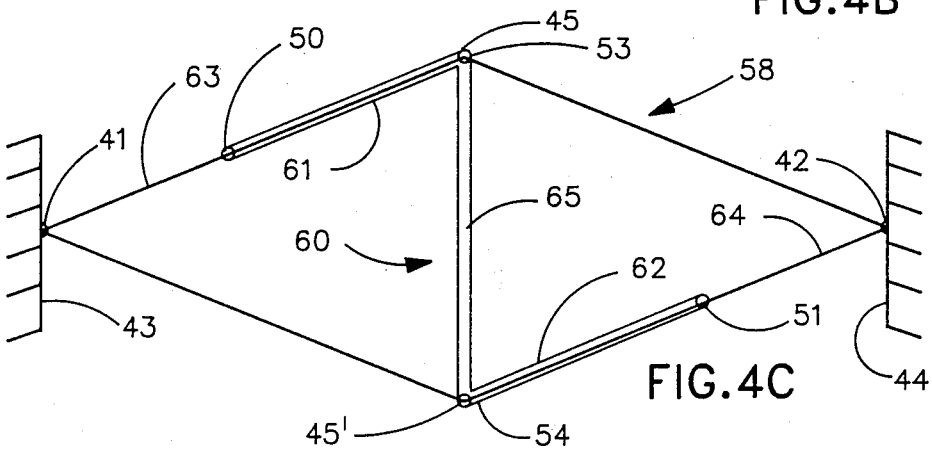

FIG. 4*c* shows a modification to the embodiment shown in FIG. 4*b* wherein reinforcement member 60 includes elongated end portions 61 and 62 which are laterally abut their respective truss members 63 and 64. End portion 61 extends from location 50 to location 53 which, in FIG. 4*c*, is adjacent connection point 45. Similarly, end portion 62 extends from location 51 to location 54 which is adjacent connection point 45 prime. Central linking portion 65 is thus oriented in the plane of truss cell 58 along an axis perpendicular to the axis of extension thereof.

In the embodiment shown in FIG. 4*d*, truss cell 68 is reinforced by reinforcement member 70 which includes arcuate end portions 71 and 72 which are respectively attached at distal ends 50 and 51 to truss members 73 and 74. A central linking portion 75 extends between connection points 53 and 54 of arcuate end portions 71 and 72. As may be seen by the comparison of FIG. 4*d* with FIG. 4*b*, arcuate end portions 71 and 72 do not laterally abut their respective truss members completely along their length as do end portions 27, 28 and 61, 62. However, effective reinforcement takes place by the lever arm provided by arcuate end portion 71 and 72 due to the fact that they are attached to truss members 73 and 74 at locations 50, and 51, respectively and laterally abut truss members 73 and 74 at locations 53 and 54, respectively, and by virtue of the fact that linking portion 75 rigidly interconnects end portions 71 and 72.

Referencing again to FIG. 4*a*, it may be seen that all of the embodiments shown in FIGS. 4*b* through 4*c* resist side forces in the direction of vector C but do not resist side forces in the direction of vector D. When a force such as C is applied to the cell 40, as shown in FIG. 4*a*, attachment points 45 tend to deflect in the direction of the applied force C. This results in a tensile force $f_1$ at attachment point 50 and a compression force $f_2$ at connection point 53 of end portion 47. Likewise, a tensile force $f_4$ results at attachment point 51 and compression force $f_3$ at connection point 54 of end portion 49. Forces $f_1$ and $f_2$ constitute a moment couple acting on truss member 46, and forces $f_3$ and $f_4$ constitute a moment couple acting on member 47 which oppose the deflection of attachment points 45, 45' respectively, to stiffen the truss cell. From this description, it should be understood that the stiffening of the cell may be accomplished by reinforcement members of various shapes so long as attachment points 50 and 51 and connection points 53 and 54 are properly located relative to one another.

Figure 5:
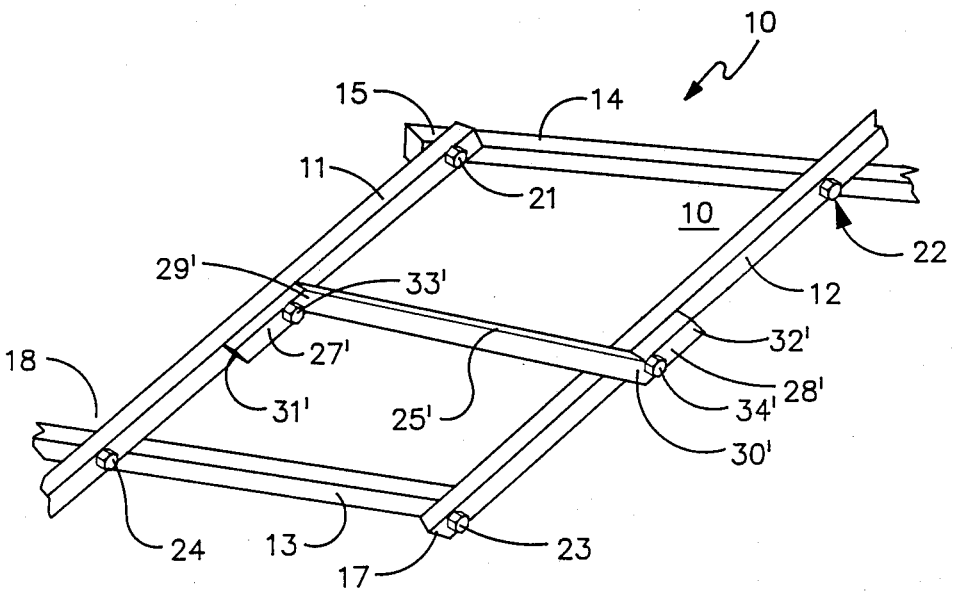
FIG. 5 is a perspective view of a first alternate embodiment of the present invention.

A first alternate embodiment of the present invention is shown in FIG. 5, and, in many respects, this alternate embodiment is substantially the same as that shown in FIGS. 1–3, above. Thus, FIG. 5 shows scissors truss 10 having cross members 11–14 pivotally attached to one another by nut and bolt sets 21–24 at points 15–18, respectively, to define truss cell 20. However, in this embodiment, the connection points 29' and 30' between linking portion 26' and end portions 27' and 28' are pivotally attached to cross members 11 and 12, by nut and bolt sets 33' and 34', respectively. Thus, outer distal end portions 31' and 32' are not attached to cross members 11 and 12 but rather pivot with respect to nut and bolt sets 33' and 34' during collapse and expansion of scissors truss 10. It should be noted, though, that, to resist the same direction side force as reinforcement member 25, it is necessary to mount reinforcement member 25' on the opposite lateral side of truss cell 10.

Figure 6:
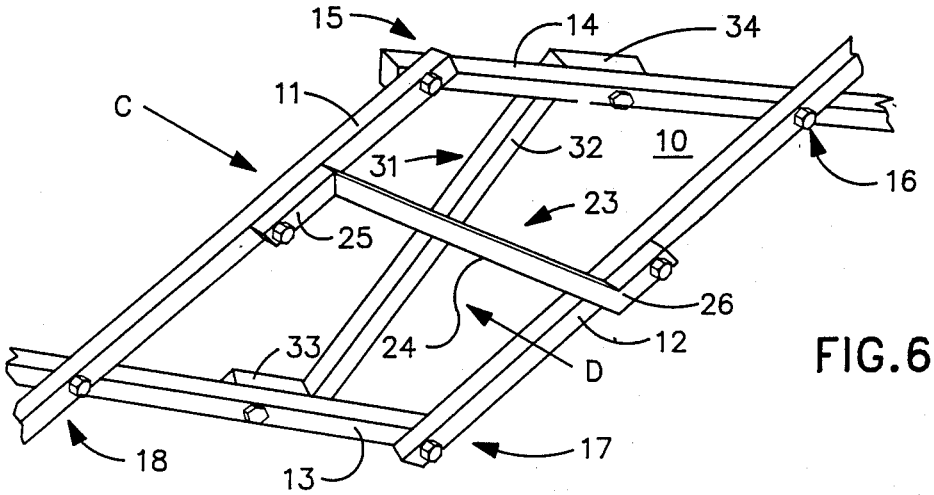
FIG. 6 is a perspective view of a second alternate embodiment of the present invention.
Figure 7:
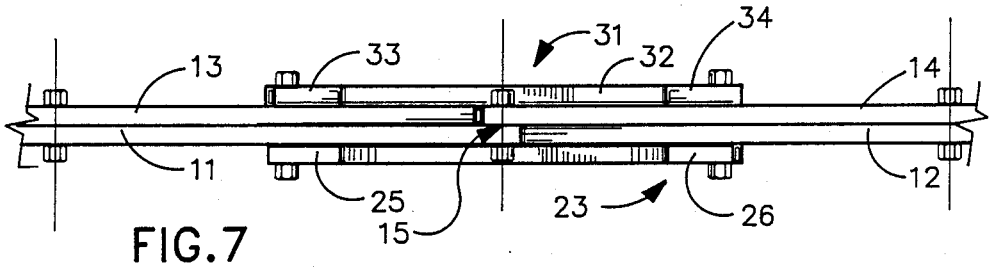
FIG. 7 is a top view of the second alternate embodiment of the present invention shown in FIG. 6.

A second alternate embodiment of the present invention is shown in FIGS. 6 and 7 in which a second reinforcement member 35 is provided on the side of cell 10 opposite reinforcement member 25. The distal ends of end portions 37 and 38 of the reinforcement member 35 are pivotally attached to truss members 13 and 14 on their sides opposite those on which members 11 and 12 are attached. The end portions 37, 38 of reinforcement member 35 are attached to linking portion 36 so that torsional and bending stress is developed in linking portion 36 to oppose a side load such as force D in the same manner as the reinforcement member 25 opposes load such as force C. Thus, the extendible scissors truss is stiffened against forces in either the direction of C or D.

Figure 8:
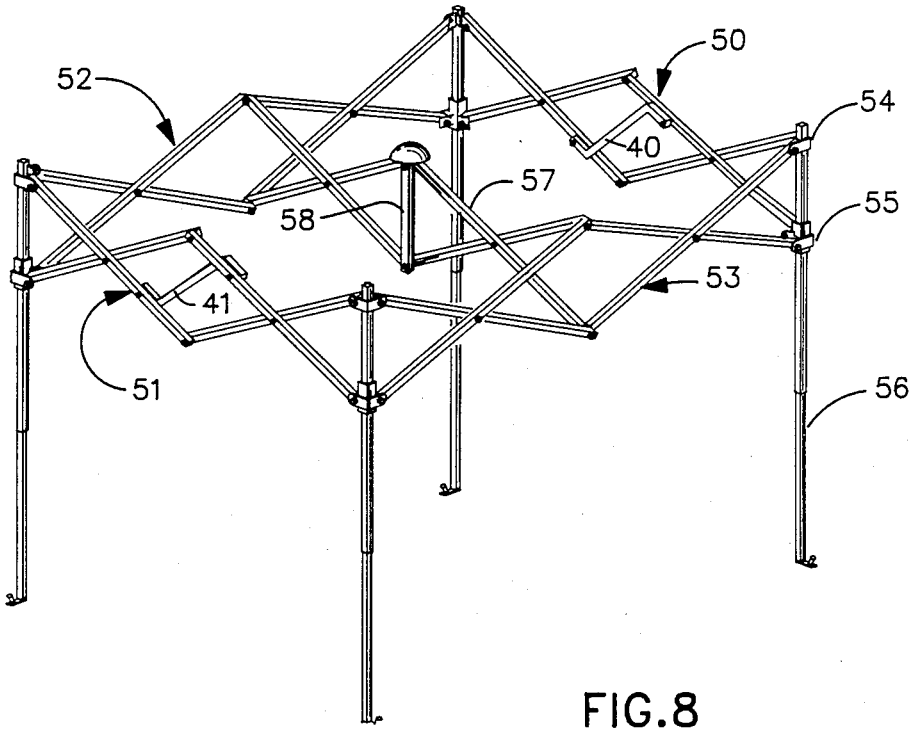
FIG. 8 is a partial perspective view of a collapsible canopy structure showing a support frame including extendible scissors trusses embodying the present invention.

Extendible scissors trusses embodying the reinforcement member of the present invention are shown in a collapsible canopy support structure 100 in FIG. 8. Canopy structure 100 is similar to that described in in my U.S. Pat. No. 4,641,676. In FIG. 8, members of the edge defining extendible scissors trusses 150, 151 152, and 153 are pivotally attached to fixed brackets 154 and slide brackets 155, with releasable latch devices, on each of the vertical corner support members 156. An internal extendible scissor truss 157 extends between two facing side extendible scissor trusses 152 and 153. A covering 160 extends across the top of the structure with sides depending downward from its perimeter. The internal scissor truss may support a center post 158 to help support the covering. Reinforcement members 140 and 141 strengthen the extendible scissors trusses 150 and 151, respectively, against inward forces on the structure such as might result from a wind blowing against a side of the canopy covering. By disconnecting center brace 158, releasing the latch devices, and drawing sliding brackets 155 downward on legs 156, extendible scissors trusses 150, 151, 152, 153 and 157 may be collapsed to a compact configuration with the four legs 156 brought close together for transport and storage.

While an exemplary extendible scissors truss embodying the present invention has been shown, it will be understood, of course, that the invention is not limited to that embodiment. Modification may be made by those skilled in the art, particularly in light of the foregoing teachings. The pivotal attachment of a Z-shaped reinforcement member such as that of FIGS. 2 and 3 may be, for example, located midway between the distal ends and the connection points of the end portions to provide limited reinforcement against forces in either direction. A reinforcement member may also be used in collapsible scissor trusses with cells having non-parallel sides, in which case the pivotal attachment means may provide for sliding, for example, along the truss members in their axial direction. It is, therefore, contemplated by the appended claims to cover any such modification which incorporates the essential features of this invention or encompasses the true spirit and scope of the invention.

I claim:

1. A reinforcement member for an extendible scissors truss, the truss having a plurality of truss members pivotally attached to one another to define a truss cell with a first pair of opposing corners and a second pair of opposing corners said reinforcement member comprising:

first and second end portions, respectively; having a first and second distal end, a first means for attaching said first end portion laterally adjacent to a first truss member;

a second means for attaching said second end portion laterally adjacent to a second truss member; and a linking portion extending between said first and second end portions with a first end of said linking portion rigidly connected to said first end portion at a first connection point spaced from said first distal end and a second end of said linking portion rigidly connected to said second end portion at a second connection point spaced from said second distal end in such a manner that, when said extendible scissors truss is in an extended configuration, said first connection point laterally abuts said first truss member and said second connection point laterally abuts said second truss member whereby said first and second end portions define first and second lever members which can exert a moment couple upon the first and second truss member.

2. A reinforcement member as in claim 1, in which said first and second attachment means are each means for pivotal attachment.

3. A reinforcement member as in claim 1, in which said first pair of corners define a first reference axis lying generally in the direction of extension of the truss and said second pair of corners define a second reference axis which crosses the first axis when the truss is in an extended configuration, and said linking portion crosses said second reference axis.

4. A reinforcement member as in claim 1 wherein said first attachment means attaches said first end portion to said first truss member at said first distal end and said second attachment means attaches said second end portion to said second truss member at said second distal end.

5. A reinforcement member as in claim 1 wherein said first attachment means attaches said first end portion to said first truss member at said first connection point and wherein said second attachment means attaches said second end portion to said second truss member at said second connection point.

6. A reinforcement member as in claim 1 in which said first end portion, said second end portion, and said linking portion lie on a common plane.

7. A reinforcement member as in claim 6 in which said first end portion, said second end portion and said linking portion together form a Z-like configuration.

8. A reinforcement member as in claim 6 in which said first end portion and said second end portion are parallel.

9. A reinforcement member as in claim 6 wherein said second pair of corners define a reference axis lying generally normal to the direction of extension of the truss and said first and second connection points each abut a respective truss member, at one of said second pair of corners.

10. An extendible scissors truss assembly comprising:

first, second, third and fourth truss members, said members arranged to define a truss cell shaped like a parallelogram, said first and second members forming a first paid of opposite sides of said cell, and said third and fourth members forming a second pair of opposite sides of said cell, said first member and said second member each pivotally attached to said third member and said fourth member;

a first reinforcement member comprising first and second end portions having a first and second distal end, respectively, and a linking portion with a first end rigidly connected to said first end portion at a first connection point spaced from said first distal end and a second end rigidly connected to said second end portion at a second connection point spaced from said second distal end;

a first means for pivotally attaching said first end portion to said first truss member at a first point; and a second means for pivotally attaching said second end portion to said second truss member at a second point, said first reinforcement member being of such size and configuration that, when said extendible scissors truss is in an extended configuration, said first connection point and said first distal end each laterally abut said first truss member and said second connection point and said second distal end each laterally abut said second truss member such that said first and second end portions define lever members operative to resist torsional and bending stress forces on the scissors truss assembly.

11. An extendible scissors truss as in claim 10, wherein said first and second truss members are laterally offset from said third and fourth truss members with said first and second truss members being located on a common first lateral side of the scissors truss assembly and with said third and fourth truss members being located a common second lateral side of the scissors truss assembly, and wherein said first and second end portions are pivotally attached to said first and second truss members laterally opposite the second side.

12. An extendible scissors truss as in claim 11 including a second reinforcement member configured similarly to said first reinforcement member, said second reinforcement member having third and fourth end portions having a third and fourth distal end respectively, third and fourth attachment means for attaching said third and fourth end portions to said third and fourth truss members, respectively, on a lateral side opposite said first lateral side, said second reinforcement member having a second linking portion rigidly connected to said third and fourth end portions at third and fourth connection points, said second reinforcement member being of such size and configuration that, when said extendible scissors truss is in an extended configuration, said third connection point and said third distal end each laterally abut said third truss member and said fourth connection point and said fourth distal end each laterally abut said fourth truss member.

13. The improvement according to claim 10 wherein said first attachment means and second attachment means define a line parallel to said third and said fourth truss members.

14. The improvement according to claim 13 wherein said line is equidistant from said third and fourth truss members.

15. In a collapsible canopy shelter movable between a collapsed position for storage and an expanded position for use on a support surface, said canopy shelter including a plurality of upright support members defining the perimeter around an area to be sheltered each support having a top and a bottom, an edge defining extendible scissor truss between adjacent upright support members and operative to expand and contract whereby the associated upright support members move away from and toward one another, and a flexible covering extending across the tops of the upright support members, said scissor truss having first, second, third and fourth truss members pivotally attached to form a truss cell shaped like a parallelogram having a first pair of corners defining a reference axis lying generally in the direction of extension and a second pair of corners transverse to said reference axis, the improvement comprising a reinforcements means for resisting torsional and bending forces acting on the second pair of corners, said reinforcement means including a first reinforcement member having first and second end portions each having a respective distal end, a first linking portion extending between said first and second end portions with a first end of the first linking portion rigidly connected to said first end portion at a first connection point spaced from the distal end thereof and with a second end of the first linking portion rigidly connected to said second end portion at a second connection point spaced from the distal end thereof, a first means for pivotally attaching said first end portion so that it is laterally adjacent to a first truss member, and a second means for pivotally attaching said second end portion so that it is laterally adjacent to a second truss member whereby when said extendible scissors truss is in an extended configuration, said first connection point and the first distal end each laterally abut said first truss member and said second connection point and the second distal end each laterally abut said second truss member on one side of the truss cell with the first linking portion extending across said truss cell on said one side whereby said first and second end portions define lever members operative to resist torsional and bending stress forces on the scissors truss assembly.

16. The improvement according to claim 15 wherein said canopy structure comprises a plurality of edge defining extendible scissor trusses each said edge defining extendible scissors truss is provided with a respective first reinforcement member.

17. The improvement according to claim 15 wherein said reinforcement means includes a second reinforcement member on a side of said truss cell opposite said one side, said second reinforcement member having third and fourth end portions each having a respective distal end, a second linking portion extending between said third and fourth end portions with a first end of the second linking portion rigidly connected to said third end portion at a third connection point spaced from the third distal end and with a second end of the second linking portion rigidly connected to said fourth end portion at a fourth connection point spaced from the fourth distal end, a third means for pivotally attaching said third end portion laterally adjacent to a third truss member, and a fourth means for pivotally attaching said fourth end portion laterally adjacent to a fourth truss member, whereby when said extendible scissors truss is in an extended configuration, said third connection point and said third distal end each laterally abut said third truss member and said fourth connection point and the said fourth distal end each laterally abut said fourth truss member on a side of the truss cell opposite said one side with the second linking portion extending across said truss cell.

18. The improvement according to claim 15 wherein each scissor truss is formed by a pair of X-shaped scissor assemblies pivotally attached end-to-end, one of said scissor assemblies being formed by said first and third truss members pivotally connected to one another at their respective mid-portions and the other of said scissor assemblies being formed by said second and fourth truss members, said second pair of corners being defined by inner ends of said first, second, third and fourth truss members, outer ends of said first, second, third and fourth truss members being secured to a pair of adjacent upright support members.

19. The improvement according to claim 18 wherein one of said outer ends secured to each upright support member is pivotally secured to a slide bracket slideably received on its associated upright support member.

20. The improvement according to claim 16 wherein each said first reinforcement member is located on a side of the respective edge defining scissor truss interiorly of said canopy shelter.

21. The improvement according to claim 20 including a second reinforcement member located on each respective edge defining extendible scissors truss each on a side of the respective scissor truss exteriorly of said canopy shelter, each said second reinforcement member including third and fourth end portions thereof pivotally attached at respective distal ends to said third and fourth truss member on a lateral side opposite said first lateral side, said second reinforcement member having a second linking portion rigidly connecting its respective end portions at third and fourth connection points, said second reinforcement member being sized and configured such that, when said extendible scissors truss is in an extended configuration, said third connection point laterally abuts to said third truss member and said fourth connection point laterally abuts to said fourth truss member.

22. The improvement according to claim 21 wherein said first, second, third and fourth attachment means pivotally attach a respective first, second, third, and fourth distal end to a respective first, second, third and fourth truss member.

* * * * *